US012497727B2

(12) United States Patent
Gunn

(10) Patent No.: US 12,497,727 B2
(45) Date of Patent: Dec. 16, 2025

(54) AGITATION ASSEMBLY FOR A WASHING MACHINE APPLIANCE

(71) Applicant: Haier US Appliance Solutions, Inc., Wilmington, DE (US)

(72) Inventor: Tanner Davis Gunn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 119 days.

(21) Appl. No.: 18/349,639

(22) Filed: Jul. 10, 2023

(65) Prior Publication Data

US 2025/0019886 A1 Jan. 16, 2025

(51) Int. Cl.

| | |
|---|---|
| ***D06F 39/02*** | (2006.01) |
| ***D06F 23/04*** | (2006.01) |
| ***D06F 34/00*** | (2020.01) |
| ***D06F 37/12*** | (2006.01) |
| ***D06F 37/30*** | (2020.01) |
| *D06F 105/46* | (2020.01) |

(52) U.S. Cl.

CPC ..... *D06F 39/024* (2013.01); *D06F 23/04* (2013.01); *D06F 34/00* (2020.02); *D06F 37/12* (2013.01); *D06F 37/304* (2013.01); *D06F 2105/46* (2020.02)

(58) Field of Classification Search

None

See application file for complete search history.

(56) References Cited

U.S. PATENT DOCUMENTS

| | | | | |
|---|---|---|---|---|
| 4,417,457 A | | 11/1983 | Brenner | |
| 4,420,952 A | * | 12/1983 | Brenner | D06F 13/02 68/53 |
| 4,478,059 A | * | 10/1984 | Yates | D06F 39/02 68/17 A |
| 5,199,281 A | | 4/1993 | Singh et al. | |

FOREIGN PATENT DOCUMENTS

| | | |
|---|---|---|
| CN | 115387060 A | 11/2022 |

* cited by examiner

*Primary Examiner* — Cristi J Tate-Sims

(74) *Attorney, Agent, or Firm* — Dority & Manning, P.A.

(57) ABSTRACT

A washing machine appliance is provided including a wash tub positioned within a cabinet, a wash basket rotatably mounted within the wash tub and defining a wash chamber configured for receiving a load of clothes, and an agitation assembly rotatably mounted within the wash basket. The agitation assembly includes an agitator element comprising a central column defining an axial direction and a radial direction, a dispensing cup positioned in the central column for receiving a wash additive, an intake port positioned on the agitator element, the intake port being spaced apart from the central column along the radial direction, and a fluid conduit fluidly coupled to the intake port, the fluid conduit defining a discharge port proximate the dispensing cup.

18 Claims, 5 Drawing Sheets

AGITATION ASSEMBLY FOR A WASHING MACHINE APPLIANCE

FIELD OF THE INVENTION

The present subject matter relates generally to washing machine appliances, or more specifically, to an agitation assembly for a washing machine appliance.

BACKGROUND OF THE INVENTION

Washing machine appliances generally include a cabinet that receives a tub for containing wash and rinse water. A wash basket is rotatably mounted within the tub. A drive assembly is coupled to the tub and configured to rotate the wash basket within the tub in order to cleanse articles within the wash basket. Upon completion of a wash cycle, a pump assembly can be used to rinse and drain soiled water to a draining system. Some washing machine appliances may also rotate the wash basket at a relatively high speed for a spin cycle to further drain or shed water from articles within the wash basket.

Certain conventional washing machine appliances include dispensing cups for receiving a wash additive (e.g., softener) to be dispensed during a wash cycle. For example, vertical axis washing machines include a dispensing cup positioned on top of the agitator element, such that spinning the agitator causes the wash additive to dispense onto the load of clothes. However, water is not typically introduced into the upper portion of the agitator resulting in the build-up of softener or other additives, potential additive leaks onto the basket above the fill line, and general griminess, resulting in customer dissatisfaction and suboptimal dispensing.

Accordingly, a washing machine appliance including an additive dispenser and a system for cleaning the additive dispenser is desirable. More specifically, an agitation assembly that cleans a dispensing cup with minimal parts, costs, and complexity would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a washing machine appliance is provided including a cabinet, a wash tub positioned within the cabinet, a wash basket rotatably mounted within the wash tub and defining a wash chamber configured for receiving a load of clothes, and an agitation assembly rotatably mounted within the wash basket. The agitation assembly including an agitator element comprising a central column defining an axial direction and a radial direction, a dispensing cup positioned in the central column for receiving a wash additive, an intake port positioned on the agitator element, the intake port being spaced apart from the central column along the radial direction, and a fluid conduit fluidly coupled to the intake port, the fluid conduit defining a discharge port proximate the dispensing cup.

In another exemplary embodiment, an agitation assembly rotatably mounted within a wash basket of a washing machine appliance is provided. The agitation assembly includes an agitator element comprising a central column defining an axial direction and a radial direction, a dispensing cup positioned in the central column for receiving a wash additive, an intake port positioned on the agitator element, the intake port being spaced apart from the central column along the radial direction, and a fluid conduit fluidly coupled to the intake port, the fluid conduit defining a discharge port proximate the dispensing cup.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
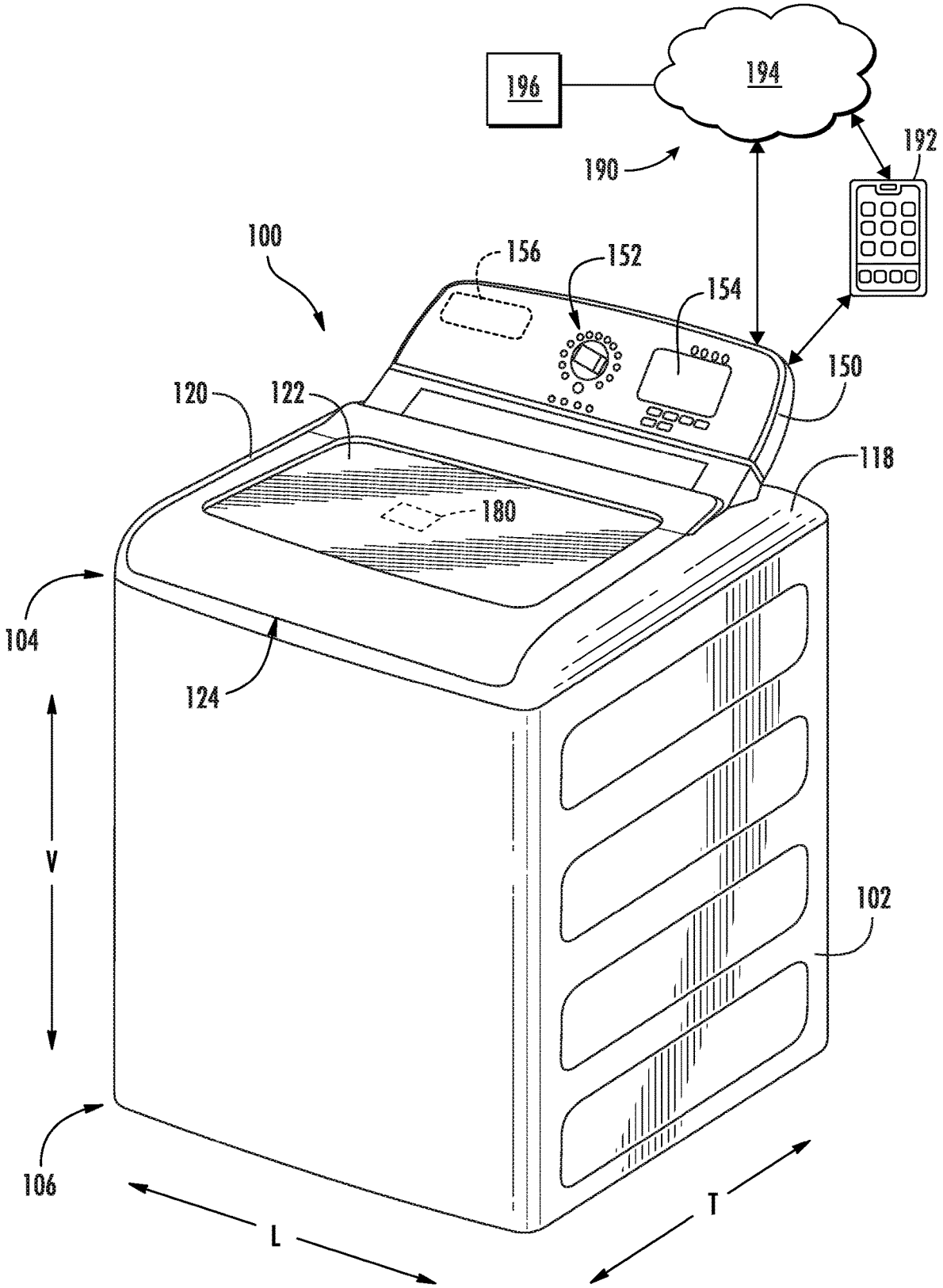
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
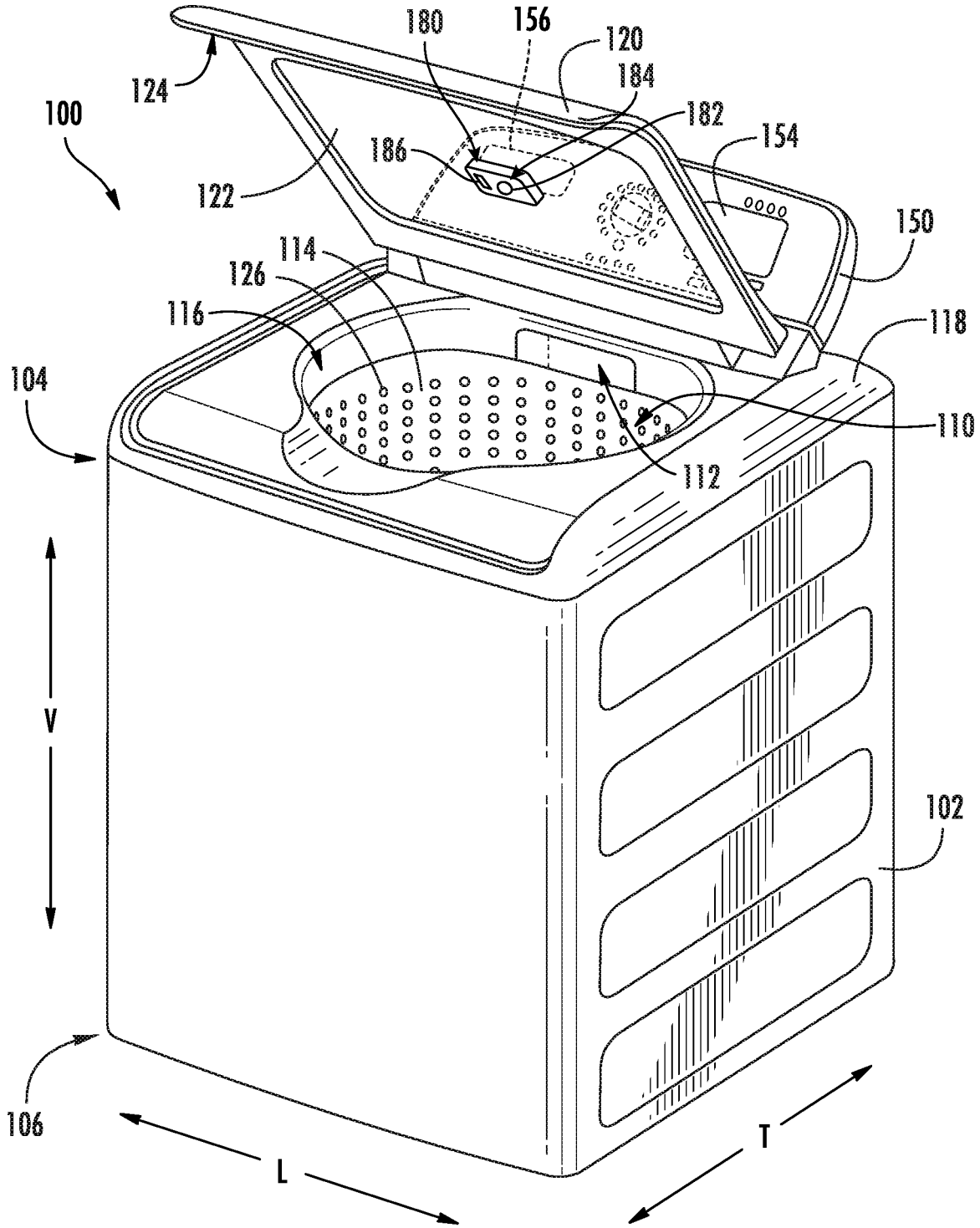
FIG. 2 provides a perspective view of the exemplary washing machine appliance of FIG. 1 with the door of the exemplary washing machine appliance shown in an open position.
Figure 3:
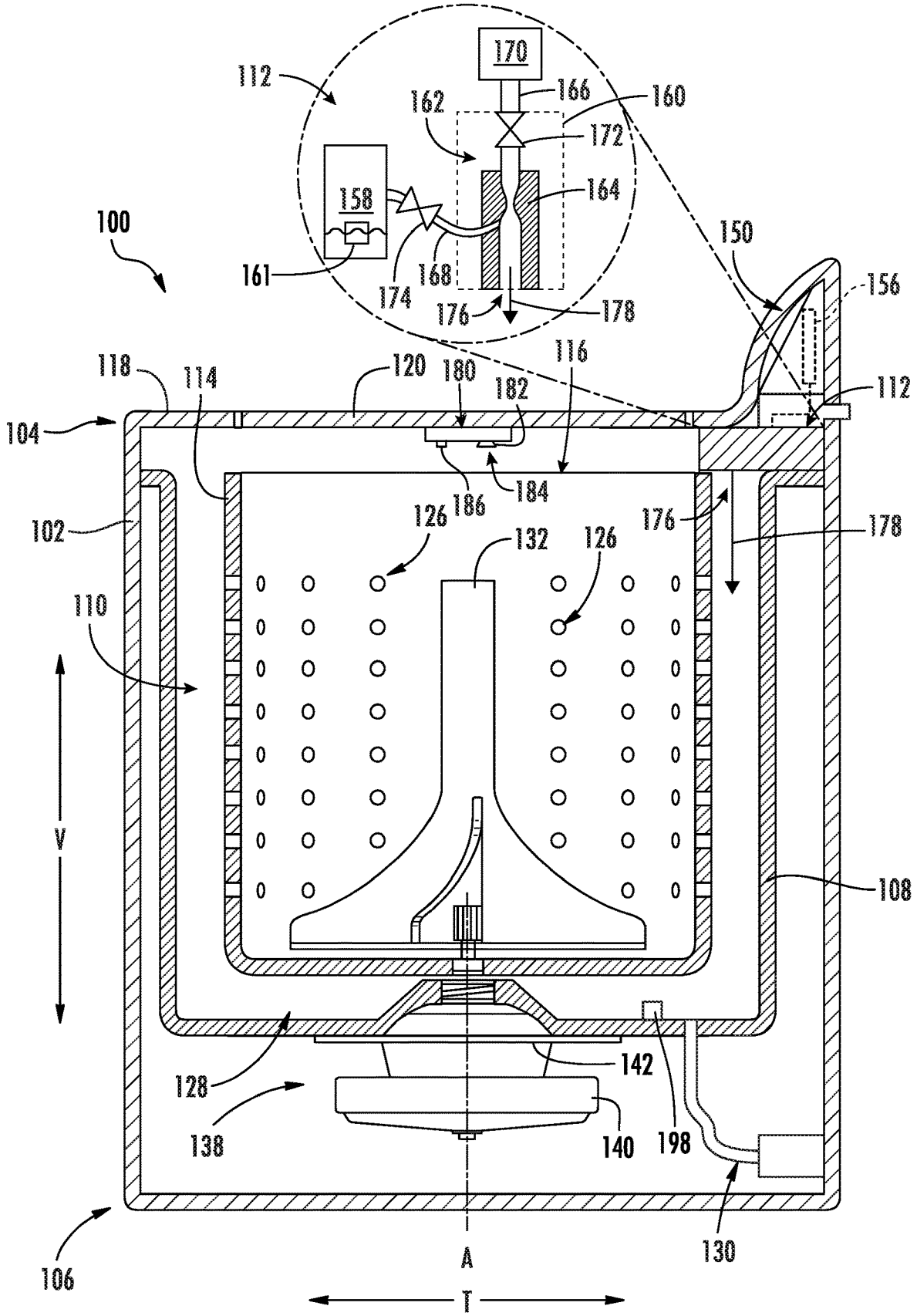
FIG. 3 provides a side cross-sectional view of the exemplary washing machine appliance of FIG. 1.

FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 100 further includes a primary dispenser or dispensing assembly 112 (FIG. 2) for dispensing wash fluid into wash tub 108.

In addition, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 114 to permit a user access to wash basket 114. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 100 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly or motor assembly 138 in mechanical communication with wash basket 114 to selectively rotate wash basket 114 (e.g., during an agitation or a rinse cycle of washing machine appliance 100). In addition, motor assembly 138 may also be in mechanical communication with agitation element 132. In this manner, motor assembly 138 may be configured for selectively rotating or oscillating wash basket 114 and/or agitation element 132 during various operating cycles of washing machine appliance 100.

More specifically, motor assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 100 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

Referring again to FIGS. 2 and 3, dispensing assembly 112 of washing machine appliance 100 will be described in more detail. As explained briefly above, dispensing assembly 112 may generally be configured to dispense wash fluid to facilitate one or more operating cycles or phases of an operating cycle (e.g., such as a wash cycle or a rinse cycle). The terms "wash fluid" and the like may be used herein to generally refer to a liquid used for washing and/or rinsing clothing or other articles. For example, the wash fluid is typically made up of water that may include other additives such as detergent, fabric softener, bleach, or other suitable treatments (including combinations thereof). More specifically, the wash fluid for a wash cycle may be a mixture of water, detergent, and/or other additives, while the wash fluid for a rinse cycle may be water only.

As best shown schematically in FIG. 3, dispensing assembly 112 may generally include a bulk storage tank or bulk reservoir 158 and a dispenser box 160. More specifically, bulk reservoir 158 may be positioned under top panel 118 and defines an additive reservoir for receiving and storing wash additive. More specifically, according to the illustrated embodiment, bulk reservoir 158 may contain a bulk volume of wash additive (such as detergent or other suitable wash additives) that is sufficient for a plurality of wash cycles of washing machine appliance 100, such as no less than twenty wash cycles, no less than fifty wash cycles, etc. As a particular example, bulk reservoir 158 is configured for containing no less than twenty fluid ounces, no less than three-quarters of a gallon, or about one gallon of wash additive.

Referring still to FIG. 3, washing machine appliance 100 may further include a one or more tank level sensors 161 that are generally configured for measuring a level or levels of wash additive within bulk reservoir 158. In this regard, for example, tank level sensors 161 may be positioned at multiple heights within bulk reservoir 158 and may be triggered when the level of wash additive falls below a predetermined height (e.g., associated with a specific wash additive volume). For example, washing machine appliance 100 may include tank level sensors 161 that indicate when the level of wash additive is full, low, empty, etc. It should be appreciated that tank level sensors 161 may utilize any suitable technology for measuring fluid levels, e.g., such as float sensors, conductivity sensors, capacitive sensors, mechanical switches, or any other suitable device or technology.

As will be described in detail below, dispensing assembly 112 may include features for drawing wash additive from bulk reservoir 158 and mixing it with water prior to directing the mixture into wash tub 108 to facilitate a cleaning operation. By contrast, dispensing assembly 112 is also capable of dispensing water only. Thus, dispensing assembly 112 may automatically dispense the desired amount of water with or without a desired amount of wash additive such that a user can avoid filling dispenser box 160 with detergent before each operation of washing machine appliance 100.

For example, as best shown in FIG. 3, washing machine appliance 100 includes an aspirator assembly 162, which is a Venturi-based dispensing system that uses a flow of water to create suction within a Venturi tube to draw in wash additive from bulk reservoir 158 which mixes with the water and is dispensed into wash tub 108 as a concentrated wash fluid preferably having a target volume of wash additive.

After the target volume of wash additive is dispensed into wash tub 108, additional water may be provided into wash tub 108 as needed to fill to the desired wash volume. It should be appreciated that the target volume may be pre-programmed in controller 156 according to the selected operating cycle or parameters, may be set by a user, or may be determined in any other suitable manner.

As illustrated, aspirator assembly 162 includes a Venturi pump 164 that is fluidly coupled to both a water supply conduit 166 and a suction line 168. As illustrated, water supply conduit 166 may provide fluid communication between a water supply source 170 (such as a municipal water supply) and a water inlet of Venturi pump 164. In addition, washing machine appliance 100 includes a water fill valve or water control valve 172 which is operably coupled to water supply conduit 166 and is communicatively coupled to controller 156. In this manner, controller 156 may regulate the operation of water control valve 172 to regulate the amount of water that passes through aspirator assembly 162 and into wash tub 108.

In addition, suction line 168 may provide fluid communication between bulk reservoir 158 and Venturi pump 164 (e.g., via a suction port defined on Venturi pump 164). Notably, as a flow of water is supplied through Venturi pump 164 to wash tub 108, the flowing water creates a negative pressure within suction line 168. This negative pressure may draw in wash additive from bulk reservoir 158. When certain conditions exist, the amount of wash additive dispensed is roughly proportional to the amount of time water is flowing through Venturi pump 164.

Referring still to FIG. 3, aspirator assembly 162 may further include a suction valve 174 that is operably coupled to suction line 168 to control the flow of wash additive through suction line 168 when desired. For example, suction valve 174 may be a solenoid valve that is communicatively coupled with controller 156. Controller 156 may selectively open and close suction valve 174 to allow wash additive to flow from bulk reservoir 158 through additive suction valve 174. For example, during a rinse cycle where only water is desired, suction valve 174 may be closed to prevent wash additive from being dispensed through suction valve 174. In some embodiments, suction valve 174 is selectively controlled based on at least one of the selected wash cycle, the soil level of the articles to be washed, and the article type. According to still other embodiments, no suction valve 174 is needed at all and alternative means for preventing the flow of wash additive may be used or other water regulating valves may be used to provide water into wash tub 108.

Washing machine appliance 100, or more particularly, dispensing assembly 112, generally includes a discharge nozzle 176 for directing a flow of wash fluid (e.g., identified herein generally by reference numeral 178) into wash chamber 108. In this regard, discharge nozzle 176 may be positioned above wash tub proximate a rear of opening 116 defined through top panel 118. Dispensing assembly 112 may be regulated by controller 156 to discharge wash fluid 178 through discharge nozzle 176 at the desired flow rates, volumes, and/or detergent concentrations to facilitate various operating cycles, e.g., such as wash or rinse cycles.

Although water supply conduit 166, water supply source 170, discharge nozzle 176, and water control valve 172 are all described and illustrated herein in the singular form, it should be appreciated that these terms may be used herein generally to describe a supply plumbing for providing hot and/or cold water into wash chamber 110. In this regard, water supply conduit 166 may include separate conduits for receiving hot and cold water, respectively. Similarly, water supply source 170 may include both hot- and cold-water supplies regulated by dedicated valves. In addition, washing machine appliance 100 may include one or more pressure sensors (not shown) for detecting the amount of water and or clothes within wash tub 108. For example, the pressure sensor may be operably coupled to a side of tub 108 for detecting the weight of wash tub 108, which controller 156 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. During or prior to the spin cycle, drain pump assembly 138 may operate to discharge wash fluid from wash tub 108, e.g., to an external drain. After articles disposed in wash basket 114 are cleaned and/or washed, the user can remove the articles from wash basket 114, e.g., by reaching into wash basket 114 through opening 116.

Referring now specifically to FIGS. 2 and 3, washing machine appliance 100 may further include a camera assembly 180 that is generally positioned and configured for obtaining images within wash chamber 110 of washing machine appliance 100. Specifically, according to the illustrated embodiment, camera assembly 180 may include a camera 182 mounted to an underside of door 120 of washing machine appliance 100. In this manner, when door 120 is in the closed position, camera 182 may be positioned over wash chamber 110 and may be oriented for obtaining images within wash chamber 110. Specifically, camera 182 is mounted such that it faces toward a bottom side of wash tub 108. In this manner, camera 182 can take unobstructed images or video of an inside of wash chamber 110, e.g., including images of wash basket 114 and discharge nozzle 176.

It should be appreciated that camera assembly 180 may include any suitable number, type, size, and configuration of camera(s) 182 for obtaining images of wash chamber 110. In general, cameras 182 may include a lens 184 that is constructed from a clear hydrophobic material or which may otherwise be positioned behind a hydrophobic clear lens. So positioned, camera assembly 180 may obtain one or more images or videos within wash chamber 110, as described in more detail below. It should be appreciated that other locations for mounting camera assembly 180 are possible, such as below or adjacent a discharge nozzle 176 of washing machine appliance 100.

Referring still to FIGS. 2 through 3, washing machine appliance 100 may further include a tub light 186 that is positioned within cabinet 102 or wash chamber 110 for selectively illuminating wash chamber 110 and the load of clothes positioned therein. Specifically, as shown in FIG. 2, tub light 186 may be integrated into camera assembly 180 and may be positioned immediately adjacent camera 182. According to still other embodiments, tub light 186 may be positioned at any other suitable location within cabinet 102. It should be appreciated that according to alternative embodiments, washing machine appliance 100 may include any other camera or system of imaging devices for obtaining images of the load of clothes or the flow of wash fluid. In addition, these cameras may be positioned at any suitable location within cabinet 102, may include any suitable lighting features, and may utilize any suitable photography or imaging technology.

Notably, controller 156 of washing machine appliance 100 (or any other suitable dedicated controller) may be communicatively coupled to camera assembly 180, tub light 186, and other components of washing machine appliance 100. As explained in more detail below, controller 156 may be programmed or configured for analyzing the images obtained by camera assembly 180, e.g., in order to determine the level of water or wash fluid within wash chamber 110, the additive content of the flow of wash fluid 178, or other cycle information, and may use this information to make informed decisions regarding the operation of washing machine appliance 100.

Referring still to FIG. 1, a schematic diagram of an external communication system 190 will be described according to an exemplary embodiment of the present subject matter. In general, external communication system 190 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 190 may be used to transfer data or other information to improve performance of one or more external devices or appliances and/or improve user interaction with such devices.

For example, external communication system 190 permits controller 156 of washing machine appliance 100 to communicate with a separate device external to washing machine appliance 100, referred to generally herein as an external device 192. As described in more detail below, these communications may be facilitated using a wired or wireless connection, such as via a network 194. In general, external device 192 may be any suitable device separate from washing machine appliance 100 that is configured to provide and/or receive communications, information, data, or commands from a user. In this regard, external device 192 may be, for example, a personal phone, a smartphone, a tablet, a laptop or personal computer, a wearable device, a smart home system, or another mobile or remote device.

In addition, a remote server 196 may be in communication with washing machine appliance 100 and/or external device 192 through network 194. In this regard, for example, remote server 196 may be a cloud-based server 196, and is thus located at a distant location, such as in a separate state, country, etc. According to an exemplary embodiment, external device 192 may communicate with a remote server 196 over network 194, such as the Internet, to transmit/receive data or information, provide user inputs, receive user notifications or instructions, interact with or control washing machine appliance 100, etc. In addition, external device 192 and remote server 196 may communicate with washing machine appliance 100 to communicate similar information.

In general, communication between washing machine appliance 100, external device 192, remote server 196, and/or other user devices or appliances may be carried using any type of wired or wireless connection and using any suitable type of communication network, non-limiting examples of which are provided below. For example, external device 192 may be in direct or indirect communication with washing machine appliance 100 through any suitable wired or wireless communication connections or interfaces, such as network 194. For example, network 194 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP. HTTP, SMTP, FTP), encodings or formats (e.g., HTML, XML), and/or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

According to example embodiments, washing machine appliance 100 may further include one or more water property sensors, e.g., identified herein as conductivity sensors 198. As best shown in FIG. 3, conductivity sensor 198 may be positioned proximate a bottom of wash tub 108, e.g., to facilitate measurement of the electrical conductivity of wash fluid that collects within wash tub 108. It should be appreciated that washing machine appliance 100 may include other conductivity sensors or systems, and that such systems may incorporate or include any suitable devices or technology for measuring the electrical conductivity of wash fluid.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machine appliances. In addition, aspects of the present subject matter may be utilized in a combination washer/dryer appliance.

Referring now generally to FIGS. 4 through 7, washing machine appliance 100 may further include agitation assembly 200 that is rotatably mounted within wash basket 114. In this regard, agitation assembly 200 may be the same or similar to agitation element 132. Specifically, according to the example embodiment, agitation assembly 200 may be configured for a top load or vertical axis washing machine appliance 100 and may include features for dispensing a wash additive (e.g., such as a fabric softener or any other suitable additive). As explained above, the dispensing of wash additive in this manner may result in the buildup of additive or other grime over time. Accordingly, aspects of the present subject matter are directed to features of agitation assembly 200 that may facilitate cleaning of the dispensing mechanism, as described in more detail below.

As shown, agitation assembly 200 may generally include in agitator element 202 that defines an axial direction A (e.g., parallel with the vertical direction V for the top load appliance) and a radial direction R that extends perpendicular to the axial direction A. According to example embodiments, agitation assembly 200 may be rotatably mounted within wash basket 114. As would be understood by one having ordinary skill in the art, motor assembly 138 may rotate agitation assembly 200 with wash basket 114 or independently of wash basket 114.

According to the illustrated embodiment, agitator element 202 may generally include an agitator base 210 that is positioned proximate a bottom of wash basket 114 and that is directly coupled to motor assembly 138. Agitator element 202 may further include a central column 212 that extends upward from agitator base 210. A plurality of vanes 214 may generally extend from agitator base 210 and central column 212, e.g., for tumbling and/or agitating wash fluid and clothes during a wash cycle. Specifically, according to the illustrated embodiment, vanes 214 may generally be helically formed around agitator base 210 and central column 212, e.g., about the axial direction A. In this manner, vanes 214 extend outward from central column 212 along the radial direction R and/or upward from agitator base 210. Although an exemplary geometry of agitator element 202 is described herein, it should be appreciated that variations and modifications may be made to agitator element 202 while remaining within the scope of the present subject matter.

Figure 6:
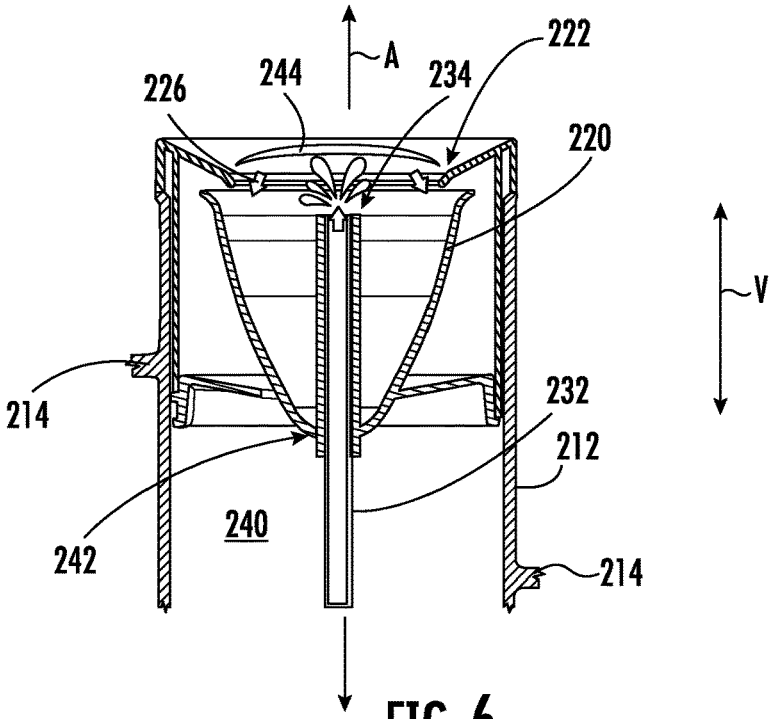
FIG. 6 provides a close-up cross-sectional view of a dispensing cup of the exemplary agitation assembly of FIG. 4 in accordance with one embodiment of the present disclosure.

As best illustrated in FIG. 6, agitation assembly 200 may further include a dispensing cup 220 that is positioned in central column 212 of agitator element 202. In general, as explained above, dispensing cup 220 may generally be configured for receiving a wash additive such as fabric softener. In general, dispensing cup 220 may have an open top 222 through which wash additive may be manually added by a user or added using a bulk dispenser. During operation, rotation of agitator element 202 may cause the wash additive to rise along the walls of dispensing cup 220 before being discharged and distributed throughout wash chamber 110. Notably, as described herein, dispensing cup 220 and surrounding surfaces have a tendency to build up excessive softener and/or grime.

Accordingly, agitation assembly 200 may further include features for flushing out or washing excessive additive from dispensing cup 220, e.g., using a flow of water or wash fluid (e.g., identified generally herein by reference numeral 226). In this regard, agitation assembly 200 may further include an intake port 230 that is positioned on agitator element 202. In general, intake port 230 is spaced apart from central column 212 along the radial direction R. In addition, a fluid conduit 232 is fluidly coupled to intake port 230 and extends upward to a discharge port 234 that is positioned proximate dispensing cup 220. As will be explained in more detail below, rotation of agitation assembly 200 may cause flow of wash fluid 226 to enter intake port 230, pass through fluid conduit 232, and be discharged through discharge port 234 for flushing out dispensing cup 220.

According to the example embodiment described herein, intake port 230 is spaced apart from central column 212 along the radial direction R. Specifically, intake port 230 may be defined at an outer radial edge of agitation assembly 220. In this manner, intake port 230 may generally experience the highest velocity of wash fluid, thereby creating an increased pressure head that facilitates the flow of wash fluid 226 into dispensing cup 220. Although intake port 230 is described herein as being positioned on agitator element 202, it should be appreciated that intake port 230 may instead be positioned directly on wash basket 114 or any other suitable rotating portion of washing machine appliance 100. Notably, intake port 230 may also be positioned towards the bottom of wash chamber 110, e.g., to avoid being blocked by clothes which have a tendency to float on top of the wash fluid. According to still other embodiments, intake port 230 may be positioned at any other suitable location that falls below a fill line of wash tub 108 (e.g., below a level to which wash fluid is filled during a normal operating cycle).

Figure 4:
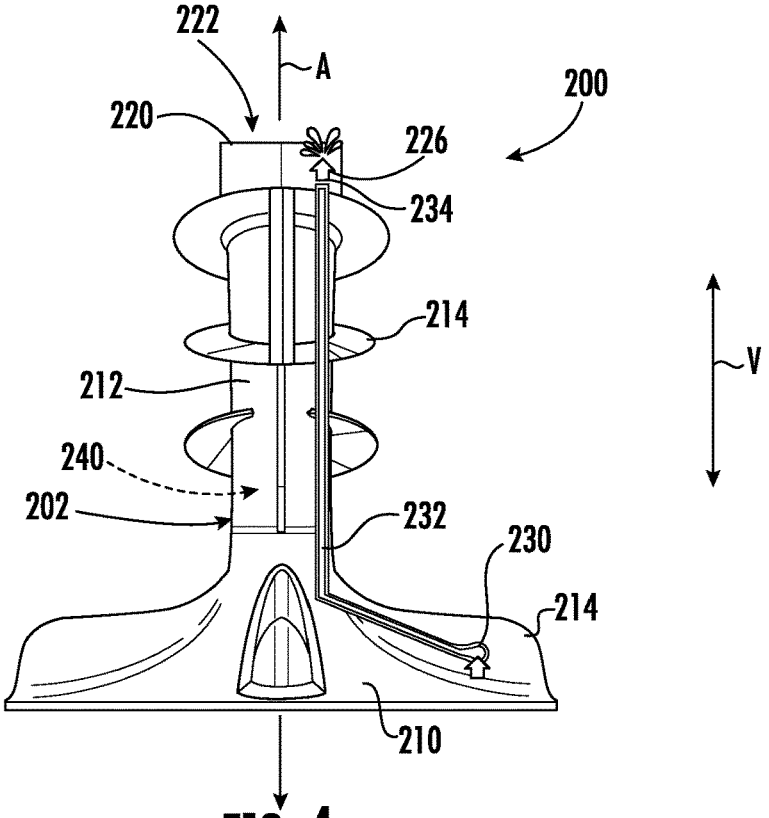
FIG. 4 provides a side view of an agitation assembly that may be used with the exemplary washing machine appliance of FIG. 1 in accordance with one embodiment of the present disclosure.
Figure 5:
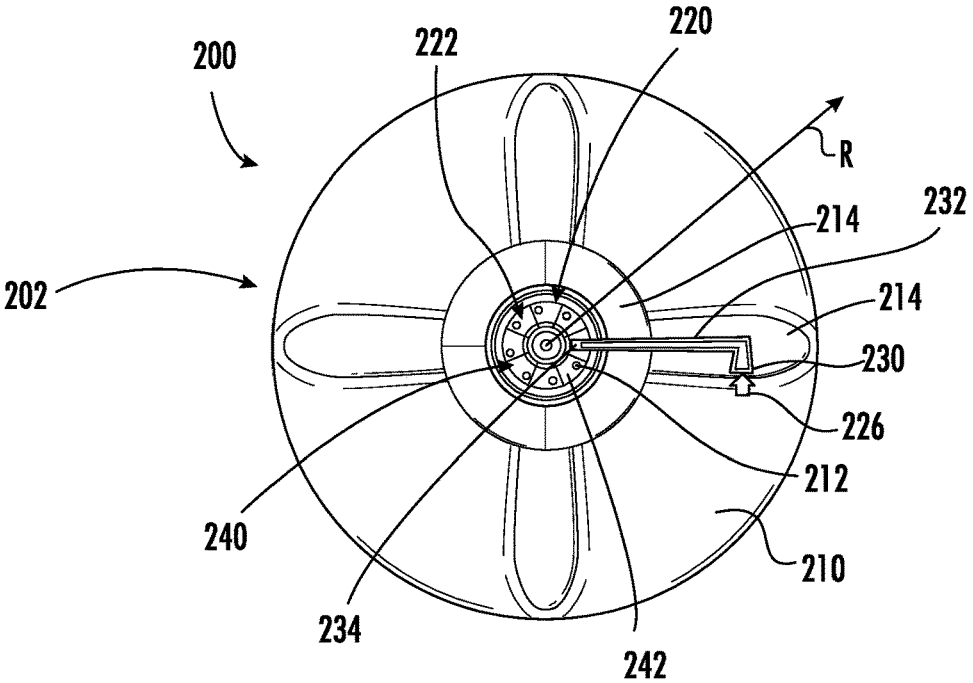
FIG. 5 provides a top view of the exemplary agitation assembly of FIG. 4 in accordance with one embodiment of the present disclosure.

As best shown in FIG. 4, intake port 230 may be defined on one or more of the plurality of vanes 214. More specifically, intake port may be oriented along a circumferential direction (e.g., perpendicular to the radial direction R). In this manner, rotation of agitator element 202 may result in the relative flow of wash fluid 226 being directed directly into intake port 230 in a manner that creates a large pressure head. It should be appreciated that other suitable locations of intake port 230 are possible and within the scope of the present subject matter.

Figure 7:
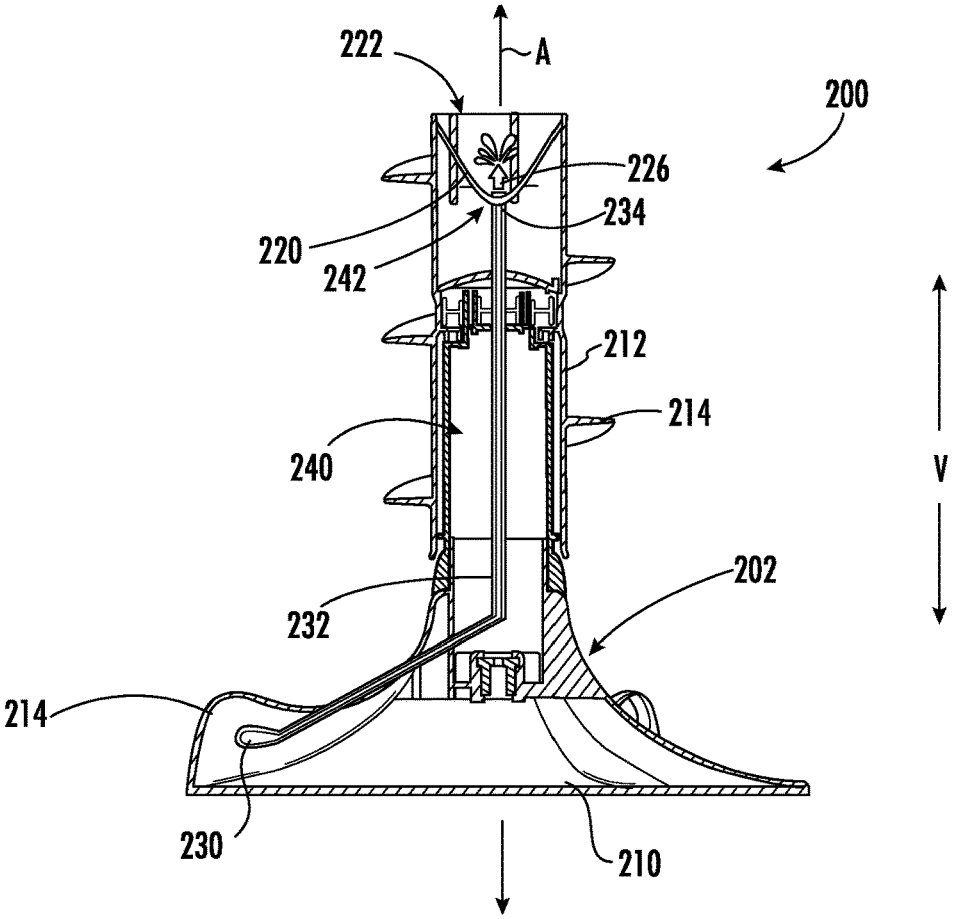
FIG. 7 provides a cross-sectional view of the exemplary agitation assembly of FIG. 4 in accordance with one embodiment of the present disclosure.

In addition, as shown in FIG. 7, fluid conduit 232 may generally pass through an interior 240 of central column 212. For example, fluid conduit 232 may generally be a tube or piping that is routed through vanes 214 and upward through interior 240 of central column 212. According to still other embodiments, fluid conduit 232 may be additively manufactured or printed into agitator element 202. It should be appreciated that the size, shape, orientation, and geometry of fluid conduit 232 may vary as needed while remaining within the scope of the present subject matter.

As illustrated, fluid conduit 232 may pass through a bottom end 242 of dispensing cup 220. In addition, discharge port 234 may generally be oriented along the vertical direction V. Agitation assembly 200 may further include a cascade cap 244 that is generally configured for redirecting the flow of wash fluid 226 outward along the radial direction R to thoroughly clean dispensing cup 220. For example, cascade cap 244 may generally define an arcuate or concave surface that redirects the flow of wash fluid 226 in all directions. It should be appreciated that according to alternative embodiments, discharge port 234 may include any suitable number of apertures or nozzles for directing the flow of wash fluid 226 in any suitable direction.

As explained above, agitation assembly 200 may generally be operably coupled to a motor assembly (e.g., such as motor assembly 138). In addition, a controller, such as controller 156 of washing machine appliance 100, may operate motor assembly 138 to facilitate cleaning of dispensing cup 220. In this regard, controller 156 may facilitate the rotation of agitation assembly 200 in a manner that urges the flow of wash fluid 226 through fluid conduit 232 and into dispensing cup 220. For example, agitation assembly 200 may be designed such that the flow of wash fluid 226 exits discharge port 234 when motor assembly 138 rotates agitator element 202 at a speed that is greater than a predetermined threshold speed. In this manner, controller 156 may directly regulate when dispensing cup 220 is cleaned (e.g., or when softener is diluted with water).

According to example embodiments, it may be desirable to rotate agitator element 202 in a direction opposite to the momentum of the flow of wash fluid within wash chamber 110. In this manner, the pressure head within fluid conduit 232 may be sufficient for thoroughly cleaning dispensing cup 220. According to example embodiments, this may be achieved by operating motor assembly 138 to rotate agitation assembly 200 in a first circumferential direction for a predetermined period of time. For example, this predetermined period of time may be selected to generate sufficient rotational motion or momentum of wash fluid within wash chamber 110. Subsequently, motor assembly 138 may rotate agitation assembly 200 in a second circumferential direction, and the intake port 230 may be oriented toward the second circumferential direction. In this manner, the relative motion or momentum of intake port 230 relative to the flow of wash fluid may be maximized for increased pressure head and cleaning ability.

As explained herein, aspects of the present subject matter are generally directed to a top load washing machine appliance including an additive dispenser within an agitator and to the us of rotational movement of the wash basket to force water from the tub to the additive dispenser, e.g., such as a fabric softener dispenser, port location, etc. For example, an inlet location is placed below the fill line and is oriented to allow fluid to enter tangentially to the rotational path of the inlet during the basket spin, creating a velocity head to move the fluid against gravity. The rotation of the basket may drive water up a pipe in the agitator post, converting the motion into a vertical flow which helps with diluting the fabric softener and preventing build-up. An umbrella cap may diffuse the fluid through the additive dispenser, and the inlet location and pipe characteristics can be adjusted for different basket speeds wherein the flow path concealed within the agitator.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:
- a cabinet;
- a wash tub positioned within the cabinet;
- a wash basket rotatably mounted within the wash tub and defining a wash chamber configured for receiving a load of clothes; and
- an agitation assembly rotatably mounted within the wash basket, the agitation assembly comprising:
  - an agitator element comprising a central column defining an axial direction and a radial direction;
  - a dispensing cup positioned in the central column, the dispensing cup defining a reservoir for receiving and storing a wash additive;
  - an intake port positioned on the agitator element, the intake port being spaced apart from the central column along the radial direction;
  - a fluid conduit fluidly coupled to the intake port, the fluid conduit defining a discharge port proximate the dispensing cup, wherein the discharge port is oriented for directing a flow of wash fluid upward; and
  - a cascade cap for redirecting the flow of wash fluid back into the dispensing cup to clean the dispensing cup.

2. The washing machine appliance of claim 1, wherein the agitation assembly comprises:
- a plurality of vanes extending from the central column along the radial direction, wherein the intake port is positioned on the plurality of vanes.

3. The washing machine appliance of claim 2, wherein the intake port is defined within the plurality of vanes and the fluid conduit passes through an interior of the central column.

4. The washing machine appliance of claim 1, wherein the agitator element comprises an agitator base and the intake port is defined within the agitator base.

5. The washing machine appliance of claim 1, wherein the intake port is defined at an outer radial edge of the agitation assembly.

6. The washing machine appliance of claim 1, wherein the intake port is positioned at a location below a fill line of the wash tub.

7. The washing machine appliance of claim 1, wherein the fluid conduit passes through a bottom of the dispensing cup.

8. The washing machine appliance of claim 1, wherein the fluid conduit is helical about the axial direction.

9. The washing machine appliance of claim 1, further comprising:
- a motor assembly operably coupled to the agitation assembly for selectively rotating the agitation assembly; and
- a controller in operative communication with the motor assembly, the controller being configured to operate the motor assembly to rotate the agitation assembly in a manner that urges a flow of wash fluid through the fluid conduit.

10. The washing machine appliance of claim 9, wherein the flow of wash fluid exits the discharge port when the motor assembly operates at greater than a predetermined threshold speed.

11. The washing machine appliance of claim 9, wherein operating the motor assembly to rotate the agitation assembly in a manner that urges the flow of wash fluid through the fluid conduit comprises:
- operating the motor assembly to rotate the agitation assembly in a first circumferential direction for a predetermined period of time; and
- operating the motor assembly to rotate the agitation assembly in a second circumferential direction after the predetermined period of time, wherein the intake port is oriented toward the second circumferential direction.

12. The washing machine appliance of claim 1, wherein the dispensing cup is positioned proximate a top of the central column for dispensing the wash additive when the agitation assembly is rotated.

13. The washing machine appliance of claim 1, wherein the washing machine appliance is a vertical axis washing machine.

14. An agitation assembly rotatably mounted within a wash basket of a washing machine appliance, the agitation assembly comprising:
- an agitator element comprising a central column defining an axial direction and a radial direction;
- a dispensing cup positioned in the central column, the dispensing cup defining a reservoir for receiving and storing a wash additive;
- an intake port positioned on the agitator element, the intake port being spaced apart from the central column along the radial direction;
- a fluid conduit fluidly coupled to the intake port, the fluid conduit defining a discharge port proximate the dispensing cup, wherein the discharge port is oriented for directing a flow of wash fluid upward; and
- a cascade cap for redirecting the flow of wash fluid back into the dispensing cup to clean the dispensing cup.

15. The agitation assembly of claim 14, wherein the intake port is defined within a plurality of vanes and the fluid conduit passes through an interior of the central column.

16. The agitation assembly of claim 14, wherein the fluid conduit passes through a bottom of the dispensing cup and the discharge port is oriented for directing a flow of wash fluid upward.

17. The agitation assembly of claim 14, further comprising:

a motor assembly operably coupled to the agitation assembly for selectively rotating the agitation assembly; and a controller in operative communication with the motor assembly, the controller being configured to operate the motor assembly to rotate the agitation assembly in a manner that urges a flow of wash fluid through the fluid conduit.

18. The agitation assembly of claim 17, wherein operating the motor assembly to rotate the agitation assembly in a manner that urges the flow of wash fluid through the fluid conduit comprises:

operating the motor assembly to rotate the agitation assembly in a first circumferential direction for a predetermined period of time; and operating the motor assembly to rotate the agitation assembly in a second circumferential direction after the predetermined period of time, wherein the intake port is oriented toward the second circumferential direction.

* * * * *